US007234623B2

(12) United States Patent
Li

(10) Patent No.: US 7,234,623 B2
(45) Date of Patent: Jun. 26, 2007

(54) COIL-TYPE MAGAZINE FOR NAIL GUN

(75) Inventor: Jeff Li, Tali (TW)

(73) Assignee: Testo Industry Corp., Taichung Hsien (TW)

( * ) Notice: Subject to any disclaimer, the term of this patent is extended or adjusted under 35 U.S.C. 154(b) by 75 days.

(21) Appl. No.: 11/253,705

(22) Filed: Oct. 20, 2005

(65) Prior Publication Data

US 2007/0090146 A1 Apr. 26, 2007

(51) Int. Cl.
*B25C 1/00* (2006.01)
*B25C 1/04* (2006.01)

(52) U.S. Cl. ..... 227/137; 227/135; 227/120; 227/128

(58) Field of Classification Search ..... 227/137, 227/128, 109, 120, 119, 135
See application file for complete search history.

(56) References Cited

U.S. PATENT DOCUMENTS 4,518,109 A * 5/1985 Shiroyama ..... 227/109
5,683,024 A * 11/1997 Eminger et al. ..... 227/8
5,697,541 A * 12/1997 Burke et al. ..... 227/109
6,032,848 A * 3/2000 Smolinski ..... 227/136
2004/0245311 A1* 12/2004 Lin ..... 227/137
2005/0224556 A1* 10/2005 Huang ..... 227/137
2005/0263560 A1* 12/2005 Niblett et al. ..... 227/135
2006/0118596 A1* 6/2006 Wojcicki et al. ..... 227/137
2006/0289597 A1* 12/2006 Bruins et al. ..... 227/18

* cited by examiner

*Primary Examiner*—Rinaldi I. Rada
*Assistant Examiner*—Candace Brakewood
(74) *Attorney, Agent, or Firm*—Posz Law Group, PLC; R. Eugene Varndell, Jr.

(57) ABSTRACT

A coil-type magazine for nails has a body and a driving member mounted on the body. The driving member is engaged with a channel of the body and moves along the channel via springs. A spool is connected to the driving member and deviates from a handle of a nail gun. Hence, the coil-type magazine for nails is not limited by a space between the coil-type magazine and handle and it is easy to receive the nails into the coil-type magazine.

4 Claims, 5 Drawing Sheets

COIL-TYPE MAGAZINE FOR NAIL GUN

BACKGROUND OF THE INVENTION

1. Field of the Invention

The present invention relates to a magazine for a nail gun, and more particularly to a coil-type magazine, which can continuously feed nails into a nail gun and is easy to reload.

2. Description of the Related Art

A nail gun is a tool that is widely used in carpentry and construction. A nail gun allows a user to drive nails into surfaces with ease. The nail gun also allows the user to do it continuously as long as there is a steady supply of nails. Most nail guns use linked nails fed from magazines. The magazines can be a box-type, in which strips of nails are loaded in a straight track, which is usually an integral part of the nail gun; or a coil-type, in which belts of linked nails are coiled inside a drum-like container. As coil-type magazines can hold a much greater quantity of nails than box-type magazines and require less frequent reloading, the coil-type magazine is favored over the box-type magazine for applications that require a large amount of nailing work.

However, coil-type magazines are usually mounted in front of a trigger of a nail gun such that the space between the coil-type magazine and the trigger is narrow and makes reloading the magazine difficult and inconvenient. Increasing the space would only make the nail gun cumbersome and difficult to handle.

Therefore, the invention provides an improved coil-type magazine for a nail gun to mitigate or obviate the aforementioned problem.

SUMMARY OF THE INVENTION

The main objective of the present invention is to provide a coil-type magazine for a nail gun, which is not limited by the space between the magazine and a trigger of a nail gun and is easy to reload.

Other objectives, advantages and novel features of the invention will become more apparent from the following detailed description when taken in conjunction with the accompanying drawings.

DETAILED DESCRIPTION OF THF PREFERRED EMBODIMENT

Figure 1:
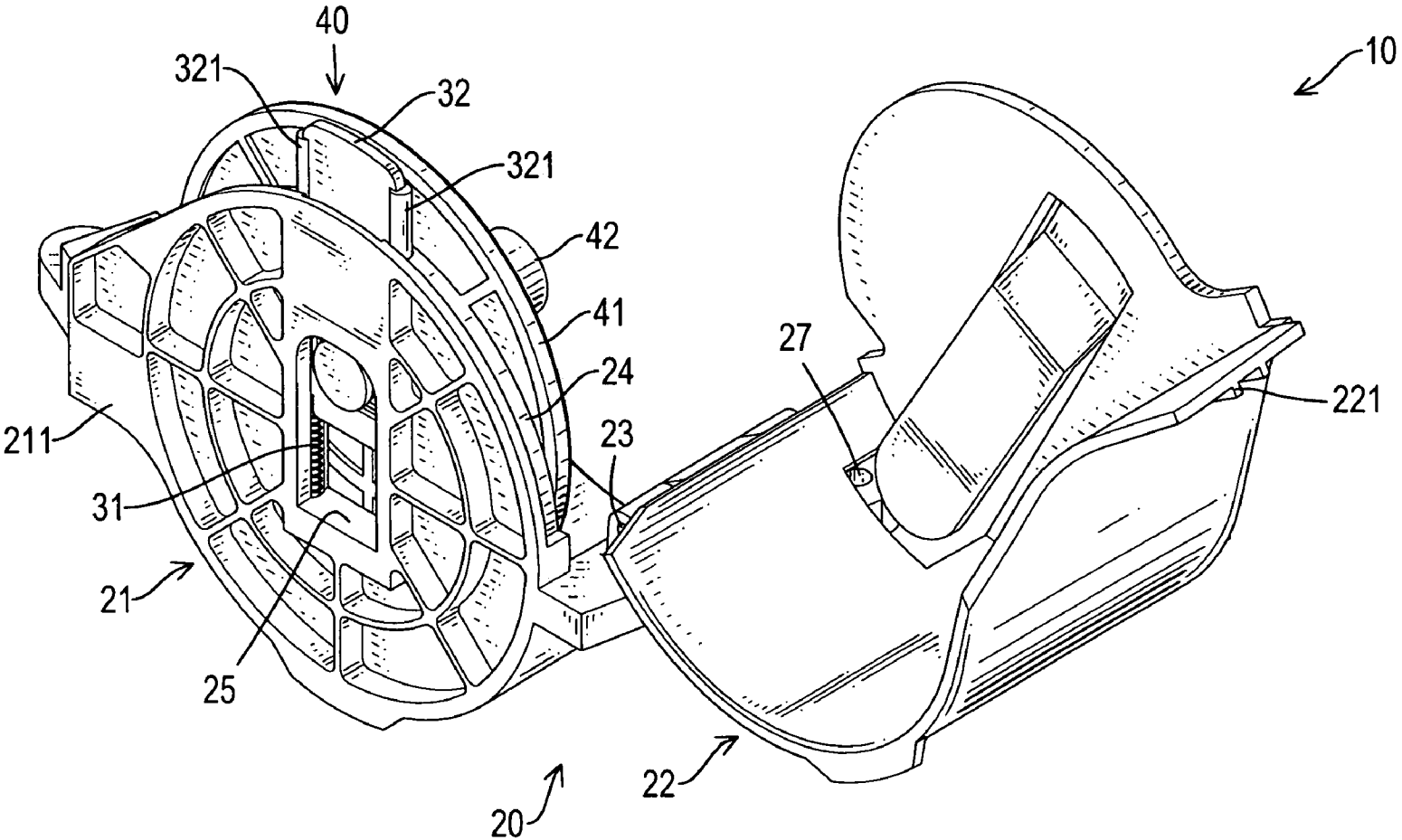
FIG. 1 is a perspective view of a coil-type magazine for a nail gun in accordance with the present invention with a cover open.
Figure 2:
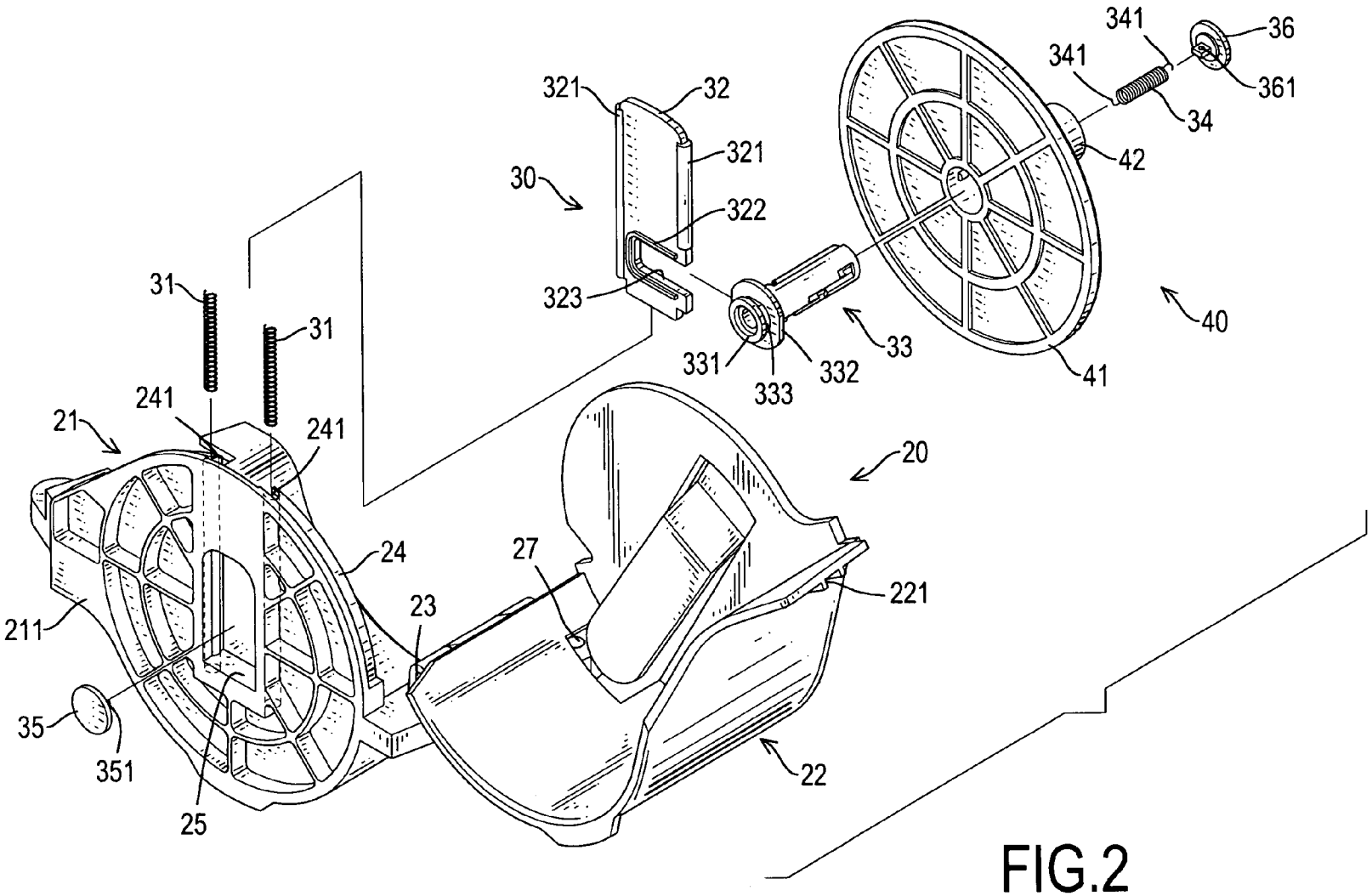
FIG. 2 is an exploded perspective view of the coil-type magazine for a nail gun in FIG. 1.
Figure 5:
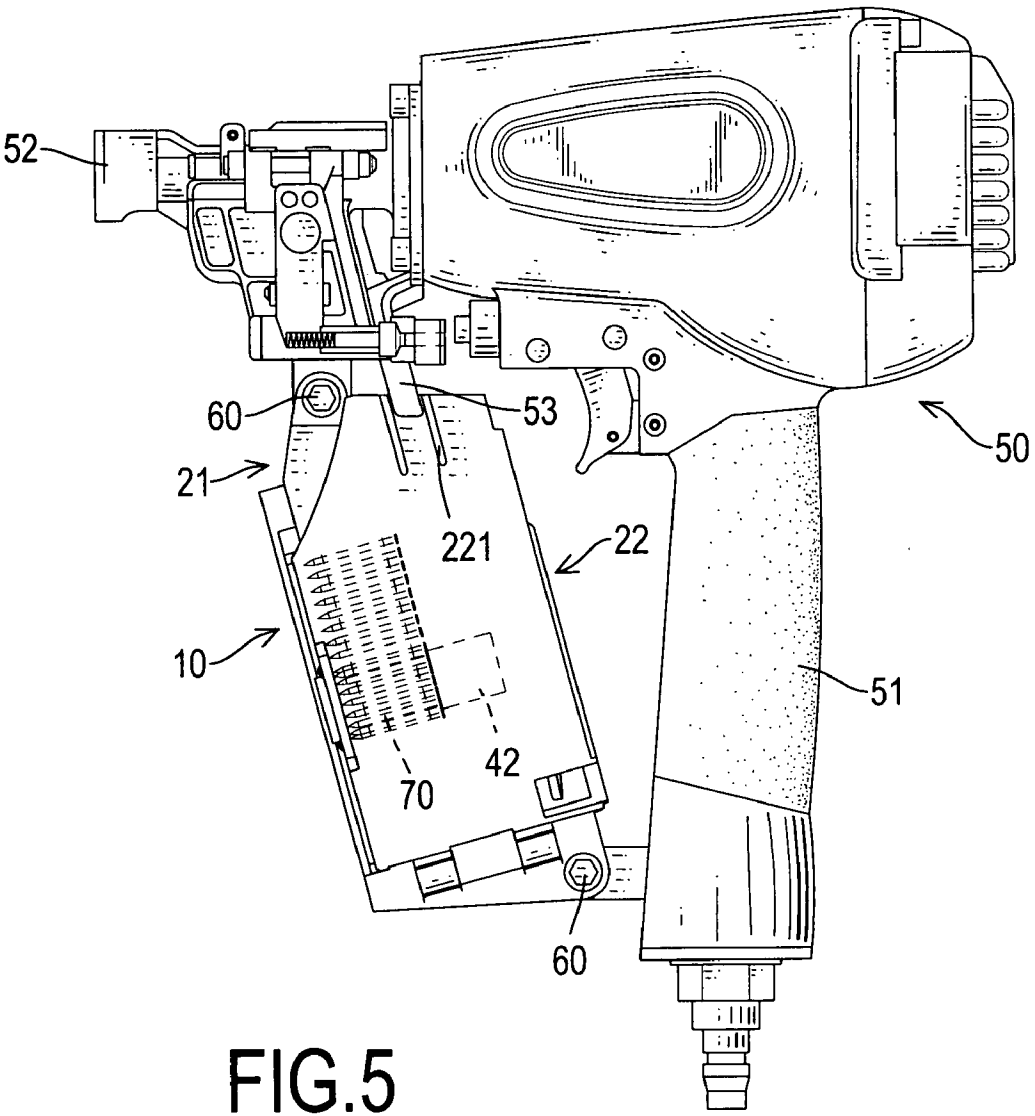
FIG. 5 is an operational side view of the coil-type magazine for a nail gun in FIG. 1.

With reference to FIGS. 1, 2 and 5, a coil-type magazine for a nail gun (10) is composed of a housing (20), a driving member (30) and a spool (40).

The drum-like housing (20) comprises a body (21) with two ends and a cover (22) corresponding to the body (21). The cover (22) is pivotally mounted at one end of the body (21) by a fastener (23). The body (21) has a substantially circular wall (211) formed at a side of the body (21) between the two ends. A seat (24) is formed along an upper edge of the wall (211) adjacent to the inner surface of the wall (211) of the body (21) to receive the cover (22). A longitudinal channel (25) is defined in the inner surface of the wall (211) from the seat (24). Two parallel slots (241) are defined respectively on opposite sides of the channel (25). A hole is defined through the wall (211) and the channel (25). The cover (22) has a wall formed at a side and is symmetrical to the wall (211) of the body. The cover (22) has a resilient element formed in the wall. The cover (22) also has a locating slot (221) defined in a distal end. A first mounting hole (26) is defined in an end of the body (21) opposite the pivot end and a second mounting hole (27) is defined in the body (21) at the pivot end.

The driving member (30) is mounted inside the housing (20) and comprises two springs (31), a plate (32) and a hollow rod (33). The plate (32) is substantially rectangular in shape and has two guide edges (321) formed on opposite sides thereof that correspond to the slots (241). A raised U-shaped track (322) is transversely formed in a lower end of plate (32) and a cutout (323) is defined within the track (322). The hollow rod (33) has a head (331) and a flange (332). The head (331) is integrally formed at an end of the rod (33) and is mounted in the track (322). The head (331) has diameter that is slightly larger than that of the rod (33). The flange (332) is formed on the rod (33) adjacent to the head (331) and has an outer diameter that is slightly larger than that of the head (331). A neck (333) is formed between the head (331) and the flange (332). The neck (333) has flats formed thereon such that when the neck (333) is mounted in the cutout (323) in the plate (32), the rod (33) will not rotate. A resilient element (34) is received into the rod (33) and has two hooks (341) formed at two ends thereof. A first cap (35) has a first attachment point (351) defined in a center of an inner surface. A second cap (36) has a second attachment point (361) defined in a center of an inner surface. The two hooks (341) of the resilient element (34) are attached to the two attachment points (351)(361), respectively.

The spool (40) is comprised of a disk (41) and a hollow tube (42) mounted on an end of the disk (41). The spool (40) is rotatably mounted on the rod (33). The diameter of the disk (41) is slightly smaller than that of the body (21) such that the disk (41) can freely rotate within the housing (20) when the cover (22) is closed over the body (21).

With reference to FIG. 2, in the assembly of the present invention, the two springs (31) are inserted respectively into the slots (241). The neck (333) of the rod (33) is mounted in the cutout (323) of the plate (32). The guide edges (321) of the plate (32) are inserted respectively into the slots (241) so that the driving member (30) is slidably mounted in the channel (25). The guide edges (321) press against the springs (31). The spool (40) is rotatably mounted over the rod (33) such that the disk (41) abuts the seat (24) of the wall (211) of the body (21). The first cap (35), with an end of the resilient element (34) attached to the first attachment point (351), is mounted to the head (331). The second cap (36) is mounted on the free end of the tube (42) of the spool (40) so that the spool (40) will not separate from the rod (33). Another end of the resilient element (34) is attached to the second attachment point (361) of the second cap (36). The driving member (30) and spool (40) assembly can now slide within the channel (25) in the body (21).

Figure 3:
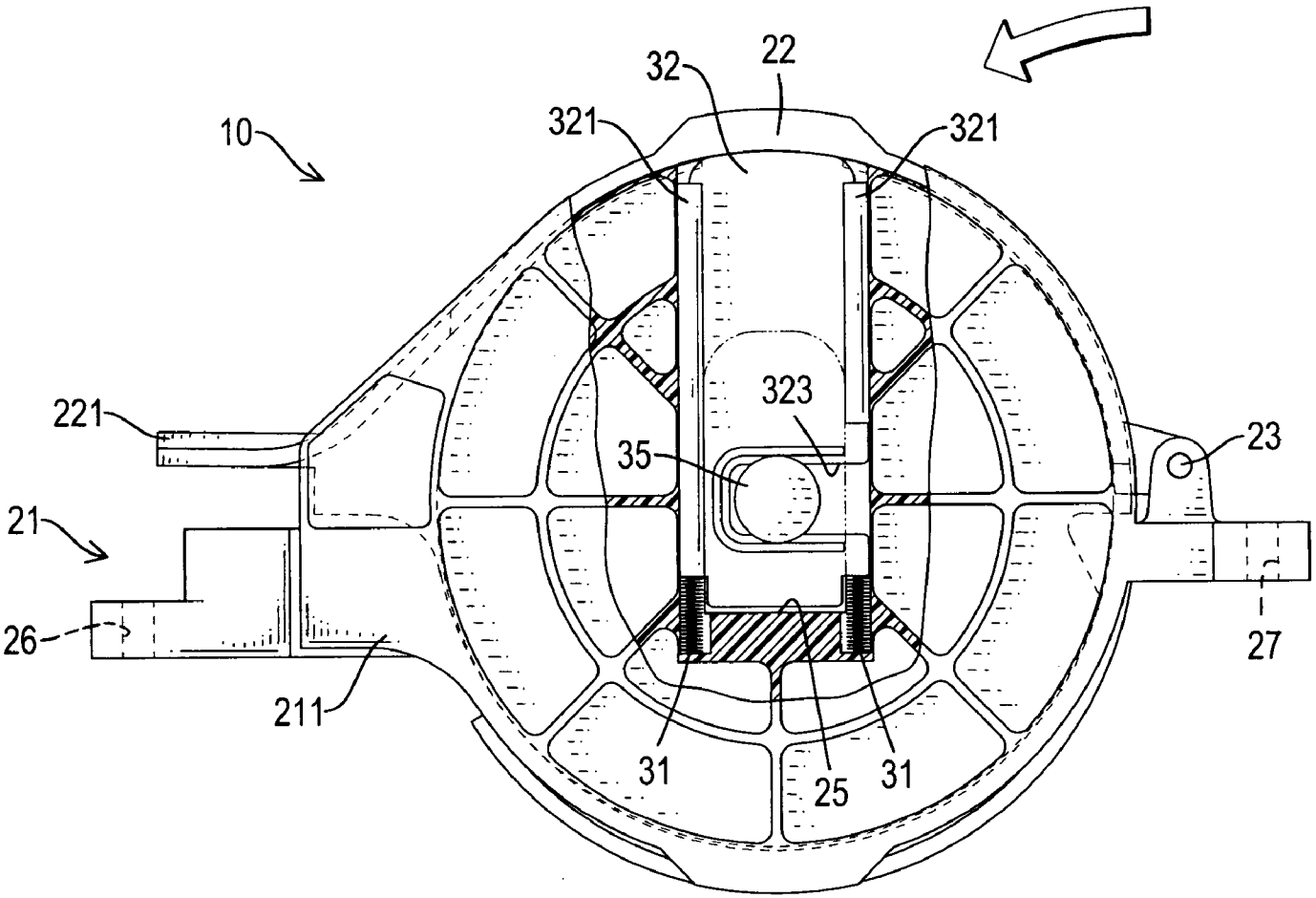
FIG. 3 is a front view in partial section of the coil-type magazine for a nail gun in FIG. 1.
Figure 4:
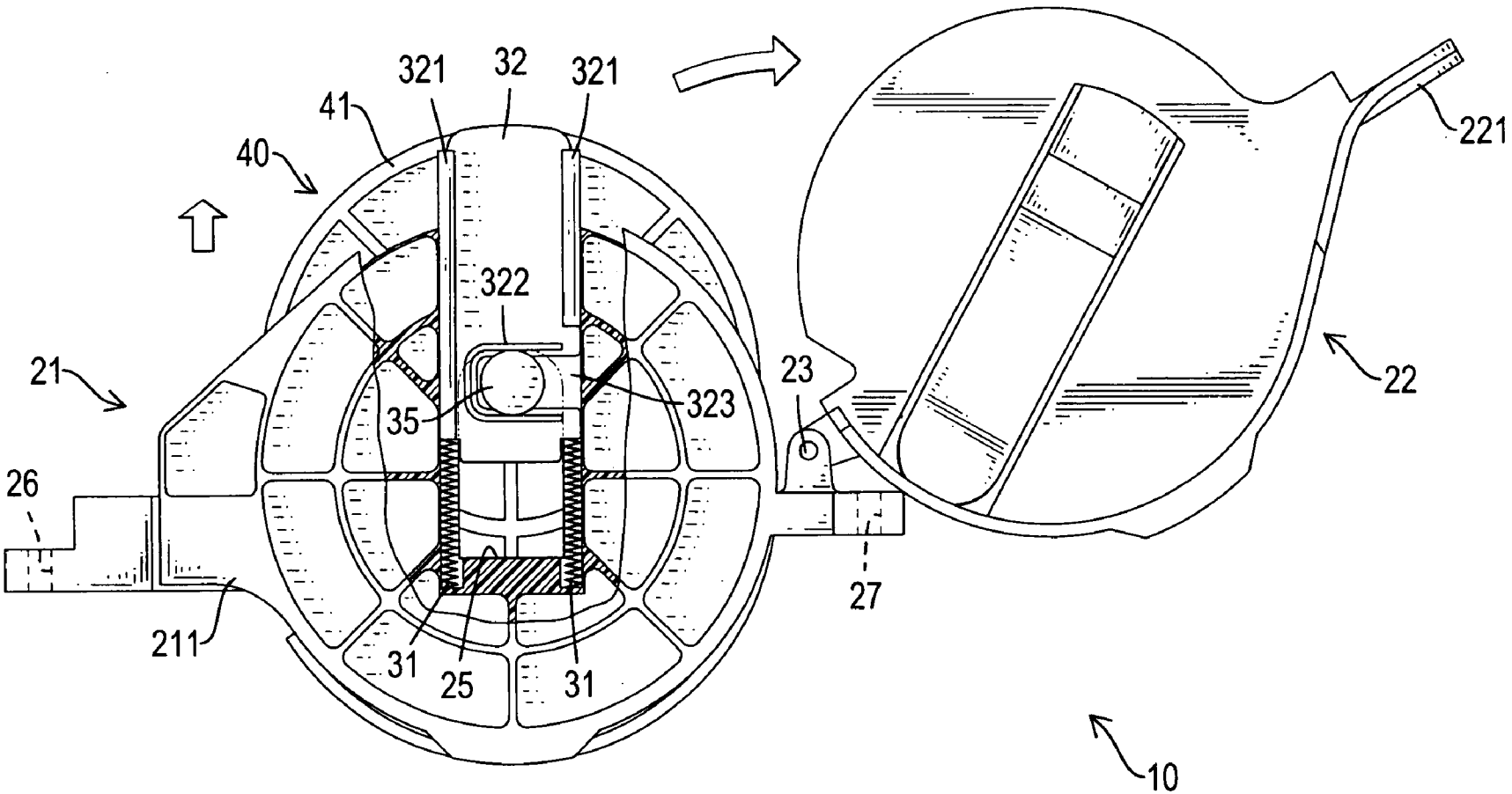
FIG. 4 is a front view in partial section of the coil-type magazine for a nail gun in FIG. 1 with the cover open.

With reference to FIGS. 3–5, when the cover (22) is closed over the body (21), an inner surface of the cover (22) abuts an outer end of the plate (32). The driving member (30) and spool (40) assembly is pushed down into the body (21). The plate (32) moves down and the two guide edges (321) compress the two springs (31). When the cover (22) is completely closed, the driving member (30) and spool (40) assembly is completely enclosed in the housing (20).

With reference to FIG. 5, the coil-type magazine (10) is mounted to a nail gun (50). The magazine (10) is properly aligned on the nail gun (50) through the locating slot (221) and the locating tab (53), respectively. The locating tab (53) also acts as a retaining tab to keep the housing (20) closed. An end of the magazine (10), the feed end, is mounted to a first end of the nail gun (50) adjacent to a muzzle (52) through the first mounting hole (26) and the pivot end of the magazine (10) is mounted to a second end of the nail gun (10) adjacent to a base of a handle (51) through the second mounting hole (27). Bolts (60) are used to secure the magazine to the nail gun (50).

When the cover (22) is opened, the resilient force of the springs (31) pushes the plate (32) and the spool (40) substantially out of the housing (20). With the spool (40) substantially out of the housing (20), a belt of linked nails (70) can be easily wound around the spool (40) to reload the magazine. The present invention is not limited by the space between the housing (20) and the handle (51) of a nail gun (50), and makes reloading easier and more convenient.

It is to be understood, however, that even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A coil-type magazine for a nail gun comprising:

a housing with a body having an integral wall, a seat formed in an upper edge of the wall adjacent to the inner surface of the wall, a longitudinal channel formed in the inner surface of the wall from the seat, two parallel guide slots defined at opposite sides of the channel, and a hole defined in the body through the wall and the channel;

a cover pivotally mounted on a pivot end of the body via a fastener having a locating slot defined in a distal end thereof, and an integral wall symmetrical to the wall of the body, a first mounting hole defined in an end of the body opposite the pivot end and adapted to be connected to a first end of a nail gun; and a second mounting hole defined in at the pivot end of the body and adapted to be connected to a second end of the nail gun;

a driving member mounted inside the housing and having two springs received respectively into the guide slots, a plate slidably mounted in the channel having two guide edges formed respectively on two sides thereof and corresponding to the guide slots, a track transversely defined in a lower end of plate, and a cutout defined in the plate within the track, and a hollow rod mounted on the plate at the cutout and having a head integrally formed on an end of the rod to insert into the track, a flange formed adjacent to the head, a neck formed between the head and the flange and engaged in the cutout, a resilient element received in the rod having two hooks formed on two opposite ends thereof, a first cap having a first attachment point defined in a center thereof and engaged with one of the two hooks, and a second cap having a second attachment point defined in a center of the cap thereof and engaged with the other of the two hook; and a spool connected to the rod and having a disk, and a hollow tube mounted on the disk wherein the rod is inserted into the disk and hollow tube in turn.

2. The coil-type magazine for a nail gun as claimed in claim 1, wherein the plate has a substantial rectangular shape.

3. The coil-type magazine for a nail gun as claimed in claim 2, wherein an outer diameter of the head and the flange are respectively larger than that of the rod.

4. The coil-type magazine for a nail gun as claimed in claim 1, wherein an outer diameter of the head and the flange are respectively larger than that of the rod.

* * * * *